US005375726A

United States Patent [19]

Lechleiter

[11] Patent Number: 5,375,726

[45] Date of Patent: Dec. 27, 1994

[54] VIAL CLIP

[75] Inventor: Robert J. Lechleiter, Pompton Plains, N.J.

[73] Assignee: Akzo Nobel, N.V., Arnhem, Netherlands

[21] Appl. No.: 152,923

[22] Filed: Nov. 16, 1993

Related U.S. Application Data

[63] Continuation of Ser. No. 835,345, Feb. 14, 1992, abandoned, which is a continuation of Ser. No. 802,275, Dec. 4, 1991, abandoned.

[51] Int. Cl.[5] ..... A47B 73/00

[52] U.S. Cl. ..... 211/74; 211/60.1; 211/68.1

[58] Field of Search ..... 611/74, 65, 66, 71, 611/60.1, 70.6; 248/909, 74.2, 68.1, 316.7, 900; 206/443

[56] References Cited

U.S. PATENT DOCUMENTS

| | | | |
|---|---|---|---|
| 676,573 | 6/1901 | Bowers | 211/70.6 |
| 1,980,930 | 11/1934 | Reyniers | 211/74 |
| 2,371,433 | 3/1945 | Davis | 211/70.6 |
| 2,637,475 | 5/1953 | Gialanella | 24/288 X |
| 2,996,329 | 8/1961 | Glazer | 206/145 X |
| 4,114,241 | 9/1978 | Bisping | 248/68.1 X |
| 4,244,542 | 1/1981 | Mathews | 248/68.1 X |
| 4,303,109 | 12/1981 | Cohen | 211/74 X |
| 4,318,528 | 3/1982 | Dobson | 248/909 X |
| 4,769,749 | 9/1988 | Felski | 248/316.7 X |
| 4,795,121 | 1/1989 | Comito | 248/316.7 X |
| 5,085,384 | 2/1992 | Kasubke | 248/68.1 X |

FOREIGN PATENT DOCUMENTS

| | | | |
|---|---|---|---|
| 186362 | 9/1956 | Germany | 211/60.1 |
| 459490 | 9/1968 | Switzerland | 211/60.1 |
| 601929 | 7/1978 | Switzerland | 248/74.2 |
| 8401121 | 3/1984 | WIPO | 211/70.6 |

*Primary Examiner*—Karen J. Chotkowski
*Attorney, Agent, or Firm*—Spencer, Frank & Schneider

[57] ABSTRACT

A linear resilient device for retaining pairs of dissimilar containers. The linear device includes a number of arm portions, each arm portion extending perpendicularly to the linear device. Each arm portion defines two arcuate surfaces engageable with two dissimilar containers. Adjacent arm portions are connected together by a frangible portion of the linear device, each frangible portion being breakable along a line parallel to the arm portions.

5 Claims, 1 Drawing Sheet

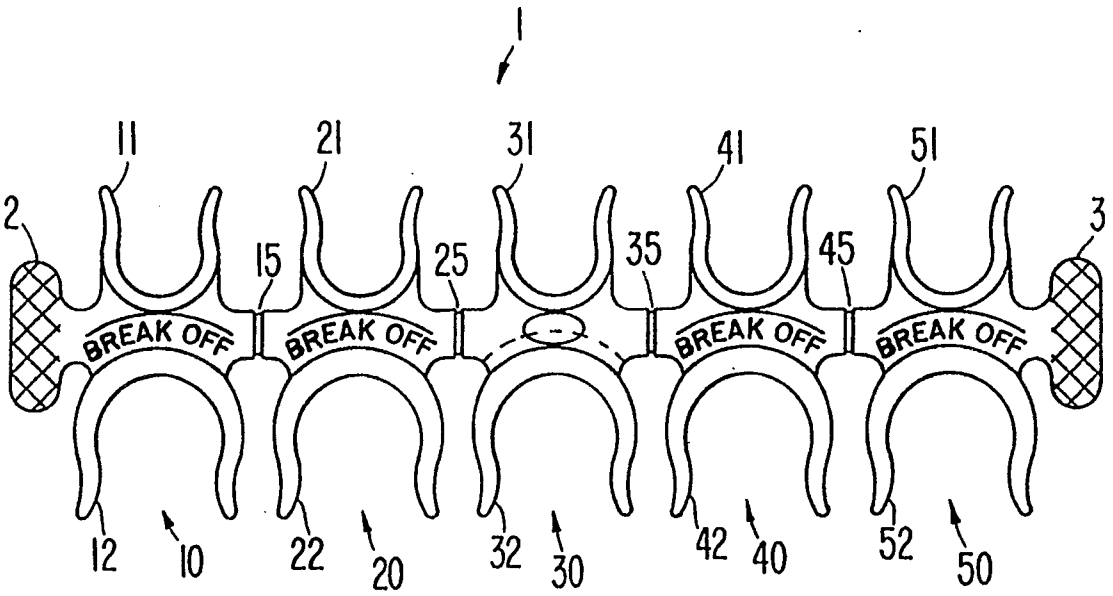
1
2
3
11
12
10
15
21
22
20
25
31
32
30
35
41
42
40
45
51
52
50
BREAK OFF
BREAK OFF
BREAK OFF
BREAK OFF

VIAL CLIP

This application is a continuation of application Ser. No. 07/835,345, filed Feb. 14, 1992, no abandoned, which is a continuation of Ser. No. 07/802,275, filed Dec. 4, 1991, now abandoned.

FIELD OF THE INVENTION

The present invention provides a linear, resilient device for retaining pairs of dissimilar containers in a preselected relationship. The device is adapted to provided for "breaking off" pairs of dissimilar containers.

TECHNOLOGY REVIEW

U.S. Pat. No. 1,980,930 describes a device to hold tubes of varying sizes securely without rattling (e.g. paragraph spanning columns 1 and 2). U.S. Pat. No. 2,637,475 describes. resilient clips for engaging beer cans, joined together in groups of four (see column 1, lines 32 to 40). U.S. Pat. No. 2,996,329 describes a plate-like bottle carrier of elastic or resilient material with openings at its perimeter for supporting bottles by their head or neck portions, the openings being so arranged that the bottles may be inserted or removed by longitudinal or swinging movement of the bottles (see column 1, lines 14 to 20). U.S. Pat. No. 4,526,576 describes a device for retaining at least two specimen collecting tubes in a spaced apart relationship. The device and specimen tubes are intended to be held in a conventional tube rack (see column 4, lines 45 to 54). U.S. Pat. No. 4,856,647 describes a device having three elastic loops to secure three containers together (see column 1, lines 5 to 11).

Nevertheless, there remains a need to provide for a linear, resilient device for retaining pairs of dissimilar containers designed to provide for "breaking off" individual portions, each portion holding one pair of dissimilar containers.

SUMMARY OF THE INVENTION

The present invention provides a linear, resilient device for retaining pairs of dissimilar containers. It is a feature of the invention that the linear, resilient device provides for "breaking off" individual portions, each portion holding one pair of dissimilar containers. It is a second feature of the invention that the linear, resilient device may be provided with end tabs for convenience in moving the device and associated containers.

It is an advantage of the invention that sets of dissimilar materials, contained within the described dissimilar containers, may be easily kept together for convenient use.

It is a second advantage of the invention that the device may be injection molded from an organic polymeric material which may be recycled or disposed of in an incinerator without release of toxic gases or contaminates into the atmosphere.

BRIEF DESCRIPTION OF THE DRAWING

The drawing illustrates a Vial Clip according to the invention.

DETAILED DESCRIPTION OF THE INVENTION

The linear, resilient device of the invention is used for retaining pairs of dissimilar containers. The device is designed to provide for "breaking off" individual pairs of dissimilar containers, which may for example contain an active pharmaceutical composition in one container and a diluent in the other container. The individual pairs of dissimilar containers provided by the device of the present invention are particularly useful in keeping a pharmaceutical composition and its proper diluent together and avoiding product mix-up in an operating room environment.

An example of the usefulness of the linear, resilient device of the present invention is with NORCURON-brand vecuronium bromide for injection. NORCURON-brand vecuronium bromide is a neuromuscular blocking agent, described in U.S. Pat. Nos. 4,237,126 and 4,297,351, used in a wide variety of surgical procedures to relax skeletal muscles. The composition is manufactured in solution, and then freeze dried to increase shelf life. When ready for administration in an operating room, the drug must be reconstituted with a bacteriostatic diluent. Safe and efficient administration to a patient requires that the proper diluent for reconstitution be promptly available. The vial clip of the present invention helps to achieve this by providing individual pairs of dissimilar containers, which may for example contain NORCURON-brand vecuronium bromide and diluent.

DESCRIPTION OF A PREFERRED EMBODIMENT

The FIGURE illustrates a preferred embodiment of the invention. As illustrated in the FIGURE the invention provides a linear, resilient device (1) for retaining pairs of dissimilar containers (A, B). The illustrated linear device includes five arm portions (10, 20, 30, 40, 50), each arm portion extending perpendicularly to the linear device. Each arm portion defines two arcuate surfaces (11-12, 21-22, 31-32, 41-42, 51-52) engageable with two dissimilar containers. Adjacent arm portions are connected together by a frangible portion (15, 25, 35, 45) of the linear device (1), each frangible portion being breakable along a line parallel to the arm portions. The ends of the linear, resilient device are provided with end tabs (2, 3) for convenience in moving the device and associated containers.

It is understood that various other modifications will be apparent to and can readily be made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A device for simultaneously retaining pairs of different-sized sealed containers having internal chambers, comprising:

a linear, essentially flat structure having a plurality of sections, each section having a plurality of arms extending perpendicularly to an axis of the linear structure, a first pair of arms of each section defining a first arcuate surface engageable with a first container and a second pair of different-sized arms of each section defining a second, different-sized arcuate surface engageable with a second, different-sized container, wherein the second pair of arms is disposed on an opposite side of the linear structure from the first pair of arms, adjacent sections being connected together by a frangible member forming part of the linear structure, each frangible member being breakable along a line perpendicular to the axis of the linear structure.

2. The device set forth in claim 1, wherein the linear structure includes a protrusion at at least one end thereof extending perpendicularly to the axis of the plurality of arms.

3. The device set forth in claim 1, wherein said linear structure includes five sections, each section for engaging and retaining first and second different-sized containers with first and second pairs of arms, respectively.

4. The device set forth in claim 1, wherein the device is formed of an organic polymeric material.

5. The device set forth in claim 4, wherein the device is formed by injection molding.

* * * * *